US009206569B1

(12) United States Patent
Roy

(10) Patent No.: US 9,206,569 B1
(45) Date of Patent: Dec. 8, 2015

(54) ICE CHOPPER ASSEMBLY

(71) Applicant: Kevin Scott Roy, Ontario (CA)

(72) Inventor: Kevin Scott Roy, Ontario (CA)

( * ) Notice: Subject to any disclaimer, the term of this patent is extended or adjusted under 35 U.S.C. 154(b) by 0 days.

(21) Appl. No.: 14/296,980

(22) Filed: Jun. 5, 2014

(51) Int. Cl.

| | |
|---|---|
| ***F25C 5/00*** | (2006.01) |
| ***B25D 3/00*** | (2006.01) |
| ***E01H 5/12*** | (2006.01) |
| ***E01H 5/02*** | (2006.01) |
| ***B28D 1/26*** | (2006.01) |
| ***F25C 5/04*** | (2006.01) |
| ***B25D 1/16*** | (2006.01) |

(52) U.S. Cl.
CPC .. *E01H 5/12* (2013.01); *B25D 1/16* (2013.01); *B28D 1/26* (2013.01); *E01H 5/02* (2013.01); *F25C 5/043* (2013.01)

(58) Field of Classification Search
CPC ..... E01H 5/12; E01H 5/02; B25D 1/16; B28D 1/26; F25C 5/043
USPC ..... 30/164.6
See application file for complete search history.

(56) References Cited

U.S. PATENT DOCUMENTS

| | | | | | |
|---|---|---|---|---|---|
| 101,424 | A | * | 4/1870 | Brown | 30/164.6 |
| 1,103,132 | A | | 7/1914 | Deininger | |
| 1,110,969 | A | * | 9/1914 | Stacy | 7/145 |
| 1,229,732 | A | * | 6/1917 | Erickson | 30/277 |
| 1,424,221 | A | * | 8/1922 | Trumpeter | 30/162 |
| 2,135,404 | A | * | 11/1938 | Lofstrand, Sr. | 241/99 |
| 2,475,041 | A | * | 7/1949 | Mattson | 173/132 |
| 2,485,877 | A | * | 10/1949 | Hamilton, Jr. | 30/277 |
| 2,546,739 | A | | 3/1951 | Georgeina | |
| 3,036,482 | A | * | 5/1962 | Kenworthy et al. | 173/90 |
| 4,294,298 | A | * | 10/1981 | Otte, Jr. | 144/195.5 |
| 4,350,192 | A | * | 9/1982 | Dent | 144/195.5 |
| 4,431,040 | A | * | 2/1984 | Friedrich et al. | 144/195.5 |
| 4,458,415 | A | | 7/1984 | Maher et al. | |
| 4,470,440 | A | * | 9/1984 | Thor | 144/195.5 |
| 4,730,653 | A | * | 3/1988 | Pantone et al. | 144/195.5 |
| 5,495,878 | A | * | 3/1996 | McKenen, Jr. | 144/195.5 |
| 5,768,785 | A | * | 6/1998 | Pessin | 30/164.6 |
| 5,787,588 | A | | 8/1998 | Tisbo et al. | |
| 5,816,632 | A | | 10/1998 | Baldacci | |
| 6,109,365 | A | * | 8/2000 | Lamoureux et al. | 173/90 |
| 6,769,182 | B1 | * | 8/2004 | Mc Cabe | 30/164.6 |
| 7,293,361 | B1 | | 11/2007 | Miller | |
| 8,291,995 | B1 | * | 10/2012 | Stoklasa | 172/371 |
| 2004/0035496 | A1 | * | 2/2004 | Ritzmann | 144/193.2 |

(Continued)

FOREIGN PATENT DOCUMENTS

| | | |
|---|---|---|
| CA | 2230840 C | 11/2005 |
| CA | 2267149 C | 11/2006 |

(Continued)

*Primary Examiner* — Hwei C Payer
(74) *Attorney, Agent, or Firm* — Malloy & Malloy, P.L.

(57) ABSTRACT

An ice chopping assembly includes at least a blade, shaft, handle, and force enhancing assembly. The blade may includes at least one face and at least one edge cooperatively structured to break ice formed on a solid surface, but may otherwise be appropriately configured to break ice. The shaft is rigidly affixed to the blade opposite the edge. The handle may be rigidly mounted to a bushing, through which a restricting device may travel. The restricting device includes a stop structure about which the bushing may be concentrically disposed. At opposite ends of the stop structure may be stop segments which limit the reciprocal travel of the blade relative to the handle.

20 Claims, 4 Drawing Sheets

(56) References Cited

U.S. PATENT DOCUMENTS

| | | | |
|---|---|---|---|
| 2010/0156124 | A1 | 6/2010 | Macri |
| 2012/0256432 | A1 | 10/2012 | Best |

FOREIGN PATENT DOCUMENTS

| | | |
|---|---|---|
| CA | 2582165 C | 3/2007 |
| WO | 9839534 | 9/1998 |

* cited by examiner

ICE CHOPPER ASSEMBLY

BACKGROUND OF THE INVENTION

1. Field of the Invention

The invention is directed toward assemblies for the breaking or chopping of ice buildup on solid surfaces. More specifically, the invention is directed toward assemblies which provide a force enhancing structure to facilitate the breaking or chopping of ice.

2. Description of the Related Art

In locations of cold climates, and particularly during autumn and spring months, a significant problem arises when ice forms on walkways, driveways, roads, or other exterior thoroughfares. This problem may arise when, for example, an overnight snow is thawed during the day, and refreezes the following night. Such ice buildup can be quite hazardous, leading to slip and fall accidents, or loss of traction of vehicle tires. This particular melting of snow and refreezing into ice can create ice buildup that is stubbornly adhered to the underlying surface and quite difficult to remove.

At least one known method of removing such buildup requires repeated chopping, breaking, and/or scraping away at the buildup which can be a daunting task given how stubbornly a layer of ice may adhere to asphalt and concrete. It is an object of the present invention to provide an ice chopper assembly which more effectively removes layers of ice buildup from solid surfaces relative to the prior art.

SUMMARY OF THE INVENTION

The invention provides a blade connected to a shaft. The blade may be used primarily to chop or break ice buildup upon solid surfaces such as, for example, a driveway. Generally, the blade may be driven into the ice substantially vertically in order to form cracks or otherwise loosen the ice from the surface. The blade may have a variety of appropriate configurations such as, but not limited to, a form that is relatively wide, compared to the width of the shaft, such that the blade may also be used to scoop, scrape, or otherwise manipulate broken ice in the manner of a spade or shovel.

Another feature of the invention is the provision of a force enhancing assembly which may either increase the force of the blow as the blade is driven into the ice, or provide a secondary blow after the blade is driven into the ice. One embodiment of the force enhancing assembly may include a weight and biasing structure disposed on the shaft of the invention. The weight may be free to slide along a length of the shaft whereas the biasing structure, which may be a coil spring disposed about the shaft, may be affixed to one end of the shaft. The weight may travel with the shaft upon an upstroke, i.e. while the blade is being raised. When a user begins the downstroke, ie. driving the blade toward the ice, the momentum of the weight may continue to compress the weight against the biasing assembly. Upon contact of the blade with the ice, the blade will abruptly stop and the biasing assembly will be allowed to uncompress, sending the weight into the blade, and delivering a secondary blow to the ice.

Another feature of the invention provides a handle. The handle may be interconnected to an end of the shaft opposite the blade. The handle may also be movable relative to the shaft and blade. In one embodiment, the shaft may have attached thereto a restricting device. The restricting device may comprise a stop structure preferably having an elongated configuration and including two stop segments. The stop segments may be disposed in spaced relation to each other. A bushing may be disposed concentrically about the stop structure in movable relation thereto, such that the bushing may slide freely between the two stop structures. Lastly, a handle may be may be rigidly attached to the bushing, such that the handle is movable with the bushing, but relative to the shaft and blade. The handle may comprise one or more handle segments.

In use, the invention may be gripped appropriately by the handle and the blade repeatedly driven into the ice until the ice breaks or otherwise loosens from the solid surface and may then be disposed of. A user may begin with an upstroke, whereby the invention is raised above the ice to be broken. Then the user may transition to a downstroke, whereby the blade is driven toward the ice and into same. This process may then be repeated until the desired affect is reached, and the user may then dispose of the loosened or broken ice appropriately.

In embodiments which include a force enhancing assembly, the upstroke should be accomplished with such vigor or speed that the weight is sent into the biasing structure. Likewise, the downstroke should be accomplished with such vigor or speed that the weight is held against the biasing structure at least until the blade collides with the ice and is abruptly stopped. This collision may then allow the weight to accelerate along the shaft and into the blade, transferring a force to the ice via the blade.

Depending upon the desired operation and effect, a user may wish to accomplish the upstroke and downstroke in such a manner as to cause the weight to collide with the blade substantially at the same time as the blade collides with the ice. Another desired operation, however, may be to first allow the blade to collide with the ice, and then allow the weight to provide a secondary blow to the ice at some time thereafter.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The invention is directed toward an ice chopper assembly 10 which may be deployed to break, chop, or otherwise loosen ice or ice buildup from solid surfaces such as, for example, a driveway, sidewalk, or road.

Figure 1:
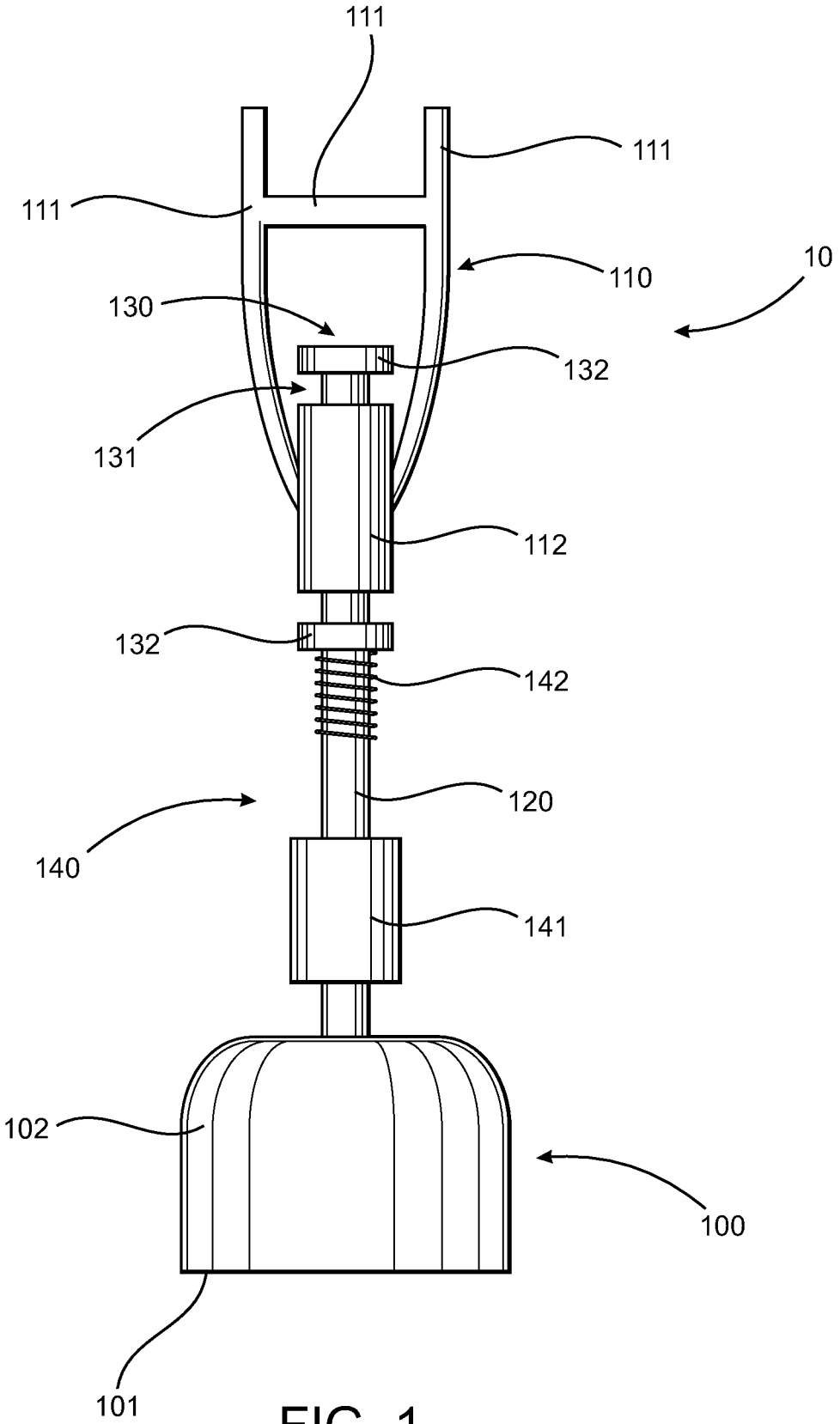
FIG. 1 is a plan view of an ice chopper assembly in accordance with one embodiment of the present invention.
Figure 2:
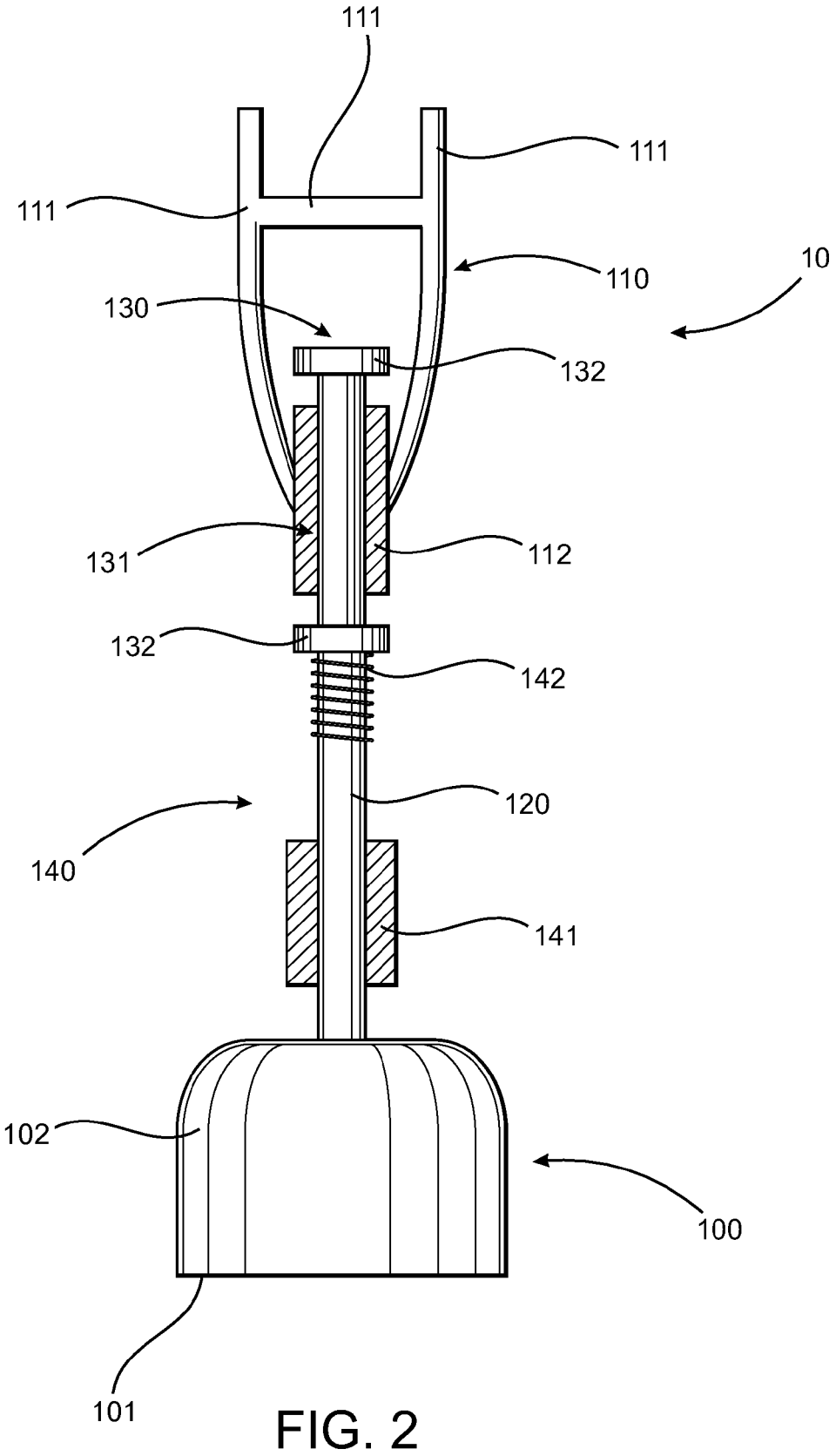
FIG. 2 is a plan section view of an ice copper assembly in accordance with the embodiment of the present invention depicted in FIG. 1.

With reference to FIGS. 1 and 2, the assembly 10 provides a blade 100 which may be driven into ice to accomplish the chopping or breaking of the ice. As such, it will be appreciated that the blade may be formed to include a variety of different, appropriate configurations and/or structures which facilitate the breaking, chopping, etc. of the ice. One example includes, but is not limited to, a blade with at least one edge 101 and at least one face 102. The blade 100 may be relatively thin so as to provide an edge 101 with a relatively small surface area, enhancing the chopping effect of the invention. Likewise, it will be appreciated that the edge 101 may be fashioned into a chisel-like or knife-like form to further enhance the chopping effect of the invention. Additionally, the blade 100 may be formed substantially in a spike configuration, obviating the need for a face 102 and edge 101.

It will also be appreciated that the blade 100 may be formed according to a variety of different aspect ratios to suit specific ice chopping needs. For example, the edge 101 may be relatively short in length in order to enhance the penetration of the blade 100 into the ice. Alternatively, the edge 101 may be relatively long in length providing a wide face 102 which may be suitable for scooping or otherwise manipulating ice chunks. The blade 100 may also be curved in order to enhance the invention's usefulness as a scooping tool.

As the blade 100 is intended to be repeatedly driven into contact with ice and other solid surfaces, it is desirable that the blade 100 have sufficient strength and durability so as to avoid failure of the blade 100 or dulling of the edge 101. A variety of relatively hard polymers may suffice but the blade may also be formed of metal as well. Likewise, the remaining components of the assembly may also be subjected to repeated impact forces such as, but not limited to, the shaft 120, bushing 112, and stop segments 132, as will be described in greater detail hereinafter. It is also desirable that these components be made from materials with appropriate characteristics to ensure the durability of the invention.

A shaft 120 may be attached to the blade 100 in order to facilitate manipulation of invention. The shaft 120 may be rigidly attached to, or unitary with, the blade 100 and disposed opposite the edge 101, extending therefrom. The shaft 120 may also be utilized to deploy a force enhancing assembly 140 on the assembly 10 and also to achieve operation of the force enhancing assembly 140 during an ice chopping procedure, to be disclosed further below.

A handle 110 may also be attached to the shaft 120, either movably, or in at least one embodiment, rigidly. The handle 110 may primarily facilitate a hand-hold on the assembly 10 such that a user may wield it competently. Accordingly, the handle 110 may be comprised of one or more handle segments 111 in a variety of different dimensions and configurations. As a non-limiting example, and as depicted in FIG. 1, two handle segments 111 may be symmetrically disposed to facilitate a two-handed grip. In at least one further embodiment, a handle segment 111 may be disposed therebetween to facilitate use of the assembly 10 as a scooping tool, or to provide structural support to the symmetrically disposed handle segments 111.

In the embodiment depicted in FIGS. 1 and 2, the handle 110 is rigidly affixed to a bushing 112. The bushing is concentrically disposed about a restricting device 130. The restricting device 130 is affixed to the shaft 120 opposite the blade 100. The restricting device 130 may comprise a stop structure 131 comprising two stop segments 132 disposed on opposite sides of the busing 112, which limit the travel of the bushing 112 relative to the stop segments 132 upon an upstroke or downstroke of the invention. In such an embodiment, the blade 100 is movably disposed relative to the handle 110, allowing the blade 100 to travel independently of and relative to the handle 110.

Figure 4:
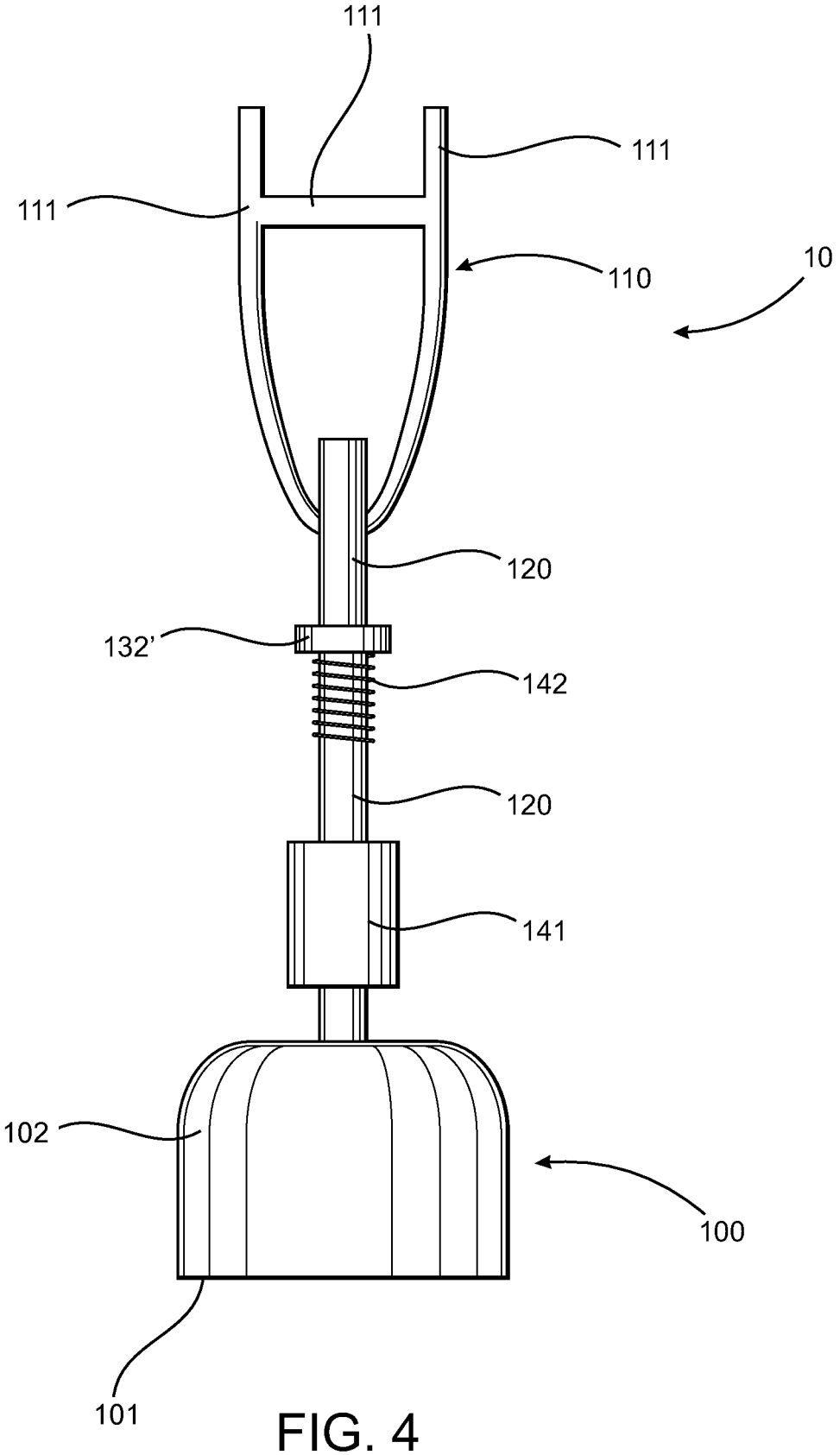
FIG. 4 is a plan view of an ice chopper assembly in accordance with another embodiment of the present invention.

In the embodiment depicted in FIG. 4, the handle 110 is rigidly attached to the shaft 120 opposite the blade 100. In this embodiment, the handle 110 does not move independently of the blade 100, as it is rigidly affixed to the blade 100 via the shaft 120. Also of note in this embodiment is the inclusion of at least one stop segment 132' which, while not necessary to restrict travel of the blade 100, facilitates the implementation of a force enhancing assembly 140.

As generally depicted in FIGS. 1-4, one embodiment of the force enhancing assembly 140 includes a weight 141 and a biasing structure 142. The weight 141 and biasing structure 142 may be disposed on the shaft 120 and in at least one embodiment, may be disposed concentrically about the shaft 120 so as to travel along the shaft 120. While not necessary, the biasing element 142 may be affixed to the shaft 120 or a stop segment 132, 132' in such a fashion as to allow the weight 141 to travel between the biasing structure 142 and the blade 100. It will also be appreciated that the stop segment 132, 132' and handle 110 may be incorporated into the same structure. In at least one embodiment the weight 141 may be constructed of a relatively heavy and durable structure and the biasing structure 142 may be constructed of a coil spring.

Figure 3:
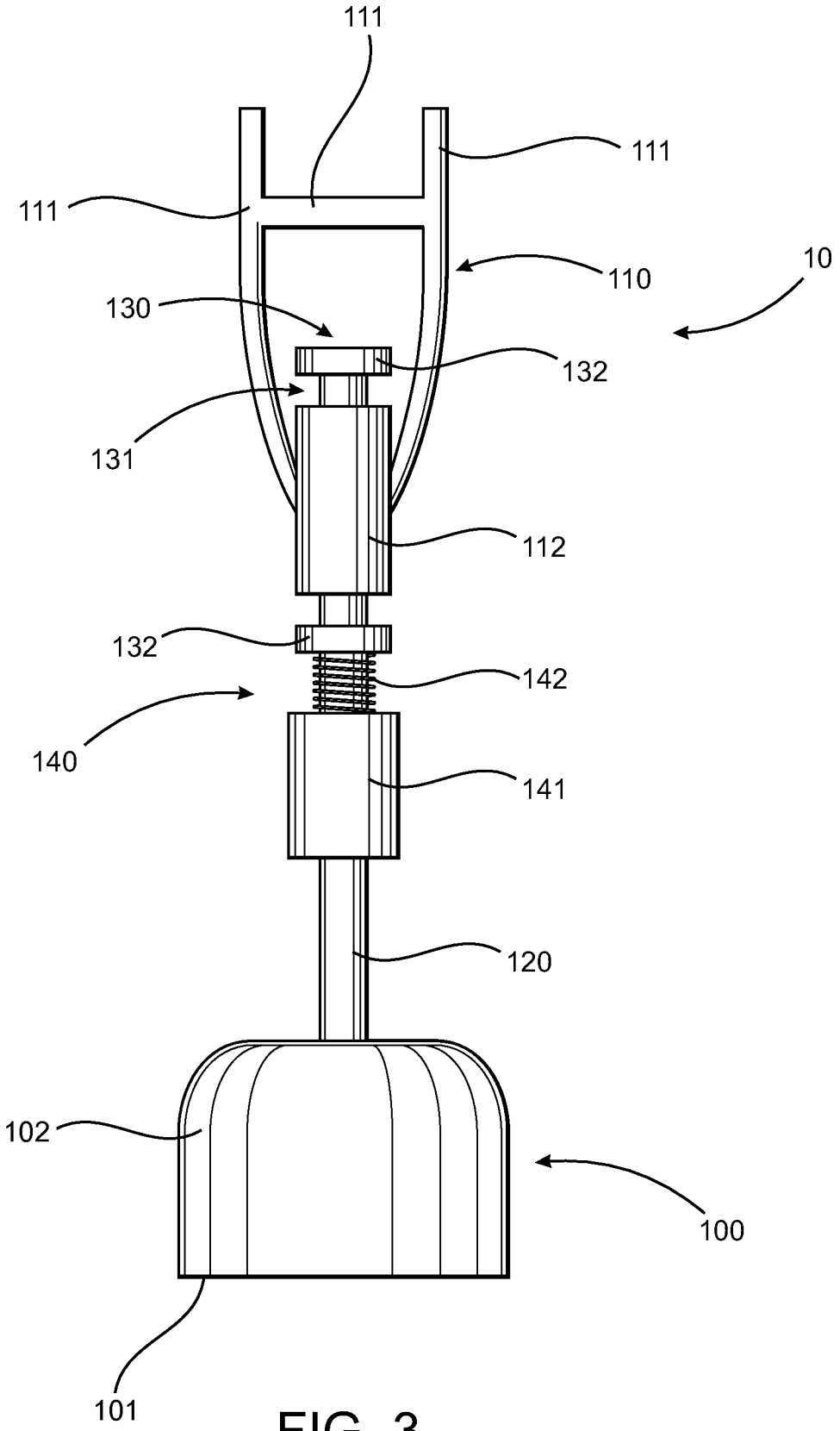
FIG. 3 is a plan view of an ice chopper assembly in accordance with the embodiment of the present invention depicted in FIG. 1, with a force enhancing assembly disposed in biased engagement.

The weight 141 may be disposable into a plurality of different relations and/or engagements. For example, the weight 141 may be disposable into a biased engagement. Upon an upstroke of the invention, the weight 141 will be given an amount of momentum by traveling with the invention. Upon transition to a downstroke of the invention, the momentum of the weight will continue to carry it into the biasing structure 142 whereby the weight 141 abuts the biasing structure 142 in such a way as to compress the biasing structure 142 or otherwise transfer energy into the biasing structure 142. Such a biased engagement between the weight 141 and the biasing structure 142 is depicted in FIG. 3.

Also, the weight may be disposable into a force delivering relation (not depicted) whereby the weight 141 transfers energy to the blade 100 via a collision with the blade 100. Such force delivering relation may be accomplished by continuing a downstroke while the weight 141 is in a biased engagement with the biasing structure 142. Upon contact of the blade 100 with the ice, the assembly 10 will abruptly stop. The biasing structure 142 will uncompress, imparting an acceleration on the weight 142 above that of gravity alone. The weight may continue to accelerate along the shaft 120 until the weight collides with the blade 100, imparting a force on the blade 100, which intern drives the blade 100 into the ice.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An ice chopper assembly comprising:

a blade dimensioned and configured to break ice formed on a solid surface, a handle connected to said blade, a shaft fixedly secured to said blade and movably interconnecting said blade to said handle, a restricting device connected to said shaft and movable therewith relative to said handle, said restricting device including a stop structure moveable relative to said handle and restricting reciprocal travel of said blade relative to said handle, a force enhancing assembly movable with and relative to said shaft and said blade, and said force enhancing assembly disposed and structured to deliver a force to said blade substantially upon impact of said blade with the ice.

2. An ice chopper assembly as recited in claim 1 wherein said blade comprises at least one edge and at least one face cooperatively structured and dimensioned to penetrate ice formed on a solid surface upon being driven into the ice.

3. An ice chopper assembly as recited in claim 1 wherein said stop structure comprises at least two stop segments each disposed and configured to restrict travel of said blade relative to said handle in an opposite direction.

4. An ice chopper assembly as recited in claim 3 wherein each of said stop segments is disposed and configured to separately abut said handle during said reciprocal travel of said blade.

5. An ice chopper as recited in claim 1 wherein said handle comprises a bushing fixedly connected thereto, said stop structure reciprocally movable within said bushing relative to said handle.

6. An ice chopper assembly as recited in claim 5 wherein said stop structure comprises at least two stop segments disposed in spaced relation to one another and further disposed and structured to restrict travel of said blade relative to said bushing in an opposite direction.

7. An ice chopper assembly as recited in claim 6 wherein each of said stop segments is disposed and configured to independently abut said bushing during said reciprocal travel of said blade.

8. An ice chopper assembly as recited in claim 6 wherein each of said two stop segments is disposed at a different opposite end of said stop structure.

9. An ice chopper assembly as recited in claim 8 wherein said bushing is disposed concentrically about said stop structure and intermediate said two stop segments, said stop structure movably disposed through said bushing.

10. An ice chopper assembly as recited in claim 1 wherein said force enhancing assembly comprises a weight and a biasing structure each movable with and relative to said shaft.

11. An ice chopper assembly as recited in claim 10 wherein said weight is reciprocally movable along said shaft in biased engagement with said biasing structure; said weight further reciprocally movable along said shaft into a force delivering relation to said blade upon said biased engagement with said biasing structure.

12. An ice chopper assembly as recited in claim 11 wherein said weight is movable along said shaft into said force delivering relation with said blade substantially corresponding to engagement of said blade with the ice.

13. An ice chopper assembly as recited in claim 12 wherein said biasing structure is disposed between said stop structure and said weight; said weight reciprocally movable along said shaft between said biased engagement with said biasing structure and said force delivering relation to said blade.

14. An ice chopper assembly as recited in claim 13 further comprising two stop segments disposed in spaced relation to one another and configured to restrict travel of said shaft relative to said handle in opposite directions.

15. An ice chopper assembly comprising:

a blade including at least one face and at least one edge cooperatively dimensioned and configured to break ice formed on a solid surface, a handle, a shaft fixedly secured to said blade and reciprocally connecting said blade to said handle, a restricting device including a stop structure connected to and movable with said shaft and into movement restricting engagement with said handle, a force enhancing assembly including a biasing structure and a weight each movable with and relative to said shaft and said blade, and said weight being reciprocally movable along said shaft in biased engagement with said biasing structure; said weight further reciprocally movable along said shaft into force delivering relation to said blade upon said biased engagement with said biasing structure.

16. An ice chopper assembly as recited in claim 15 wherein said weight is movable along said shaft into said force delivering relation with said blade substantially corresponding to engagement of said blade with the ice.

17. An ice chopper assembly as recited in claim 16 wherein said biasing structure is disposed between said stop structure and said weight; said weight reciprocally movable along said shaft between said biased engagement with said biasing structure and said force delivering relation with said blade.

18. An ice chopper assembly as recited in claim 15 wherein said handle comprises a bushing fixedly connected thereto, said stop structure reciprocally movable within said bushing relative to said handle.

19. An ice chopper assembly as recited in claim 18 wherein said stop structure comprises at least two stop segments each disposed and configured to restrict travel of said shaft and said blade relative to said bushing in an opposite direction.

20. An ice chopper assembly as recited in claim 19 wherein each of said stop segments is disposed and configured to separately abut said bushing during said reciprocal travel of said blade.

* * * * *